United States Patent [19]

Chielens et al.

[11] 4,370,128

[45] Jan. 25, 1983

[54] PROTECTIVE DEVICE FOR A DISCHARGE END OF A TUBULAR ROTARY KILN

[75] Inventors: Alain Chielens, Marc-en-Baroeul; Bernard Boussekey, Lille; Bernard Deschamps, Villeneuve d'Ascq, all of France

[73] Assignee: Fives-Cail Babcock, Paris, France

[21] Appl. No.: 320,555

[22] Filed: Nov. 12, 1981

[30] Foreign Application Priority Data

Nov. 21, 1980 [FR] France ..... 80 24728

[51] Int. Cl.[3] ..... F27B 7/24; F27B 7/38; F27B 7/28

[52] U.S. Cl. ..... 432/115; 432/116; 432/119

[58] Field of Search ..... 432/103, 115, 116, 119

[56] References Cited

U.S. PATENT DOCUMENTS 2,266,396 12/1941 Lincoln et al. ..... 432/116
3,682,453 8/1972 Powell ..... 432/116
4,295,825 10/1981 Chielens et al. ..... 432/116

*Primary Examiner*—John J. Camby
*Attorney, Agent, or Firm*—Kurt Kelman

[57] ABSTRACT

A protective device for a discharge end of a tubular rotary kiln comprises a flange extending radially outwardly of the metal kiln shell, a metallic ring affixed to the flange and arranged concentric with the shell at the discharge end, and a refractory ring covering the metallic ring and the front face of the flange. Two sleeves concentrically surrounding the external surface of the metal shell to define respective inner and outer annular chambers through which cooling air is circulated to cool the rear face of the flange, a space between the metallic ring and the internal surface of the metal shell communicating with the outer annular chamber through a passage between the rear face of the flange and the discharge end, and with the inner annular chamber through a port in the metal shell spaced inwardly of the discharge end.

11 Claims, 4 Drawing Figures

PROTECTIVE DEVICE FOR A DISCHARGE END OF A TUBULAR ROTARY KILN

The present invention relates to a protective device for a discharge end of a tubular rotary kiln through which hot products treated in the kiln are removed, such kilns including a metal shell having an internal and external surface, and the metal shell terminating in the discharge end.

Known protective devices of this kind comprise a flange affixed to the discharge end of the metal shell and extending radially outwardly of the rotary kiln shell and having a front face and a rear face, and a ring of refractory material covering the internal surface of the metal shell at the discharge end as well as the front face of the flange. The flange and discharge end of the metal shell are cooled by air circulated through two annular chambers defined by two sleeves concentrically surrounding the metal shell. Such a protective device is disclosed, for example, in U.S. Pat. No. 4,295,825, dated Oct. 20, 1981.

In this known protective device, only the external surface of the metal kiln shell is cooled by the circulating air at the discharge end, which results in deformations of this portion of the metal shell and such deformations may cause damage to, or even the destruction of, the protective ring fixed thereto.

It is the primary object of this invention to improve on this type of protective device and to assure cooling of the internal as well as of the external surface of the metal shell at the discharge end of the kiln.

In a protective device of the general type described hereinabove, the invention accomplishes the above and other objects by providing a metallic ring affixed to the flange and arranged concentric with the metal shell at the discharge end, the metallic ring and the internal surface of the metal shell defining a space therebetween. The ring of refractory material is supported by the metallic ring and covers the metallic ring and the front face of the flange for protecting the internal surface of the shell at the discharge end and the front face of the flange. Means for cooling the rear face of the flange includes two sleeves concentrically surrounding the external surface of the metal shell, an inner one of the sleeves defining an annular chamber with the external surface and an outer one of the sleeves defining another annular chamber with the inner sleeve, means for circulating cooling air through the annular chambers past the rear face of the flange, and the space between the metallic ring and the internal surface of the metal shell communicating with the outer annular chamber through a passage defined between the rear face of the flange and the discharge end of the metal shell, and with the inner annular chamber through a port in the metal shell spaced inwardly of the discharge end.

Figure 1:
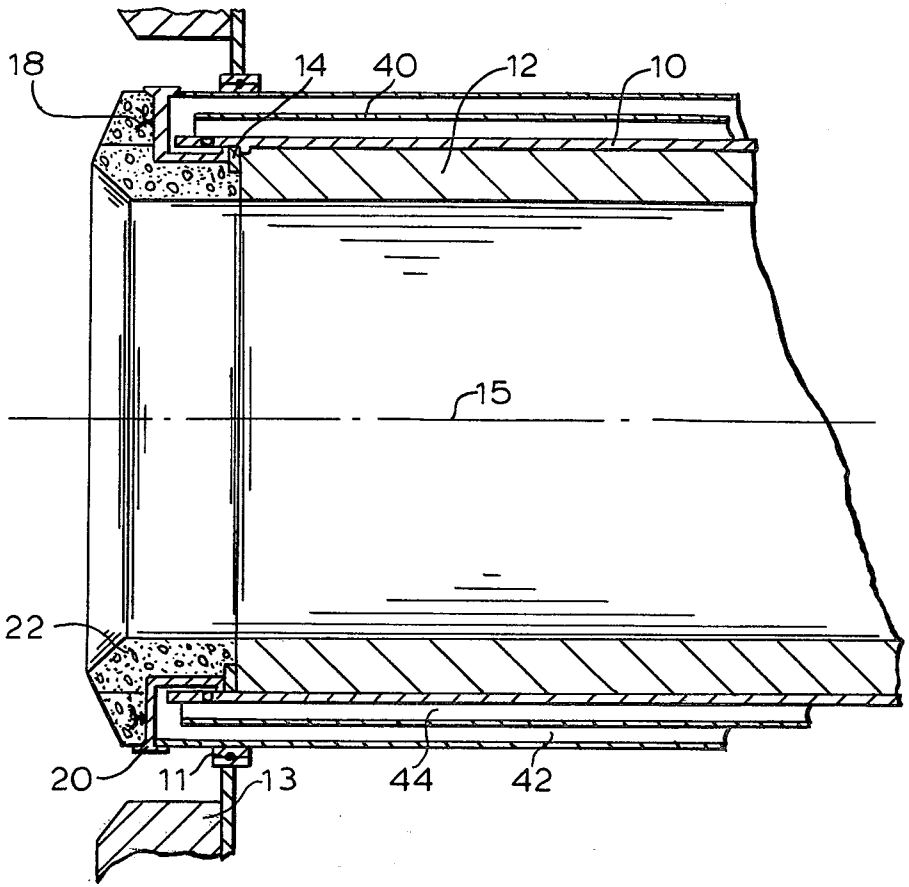
Figure 2:
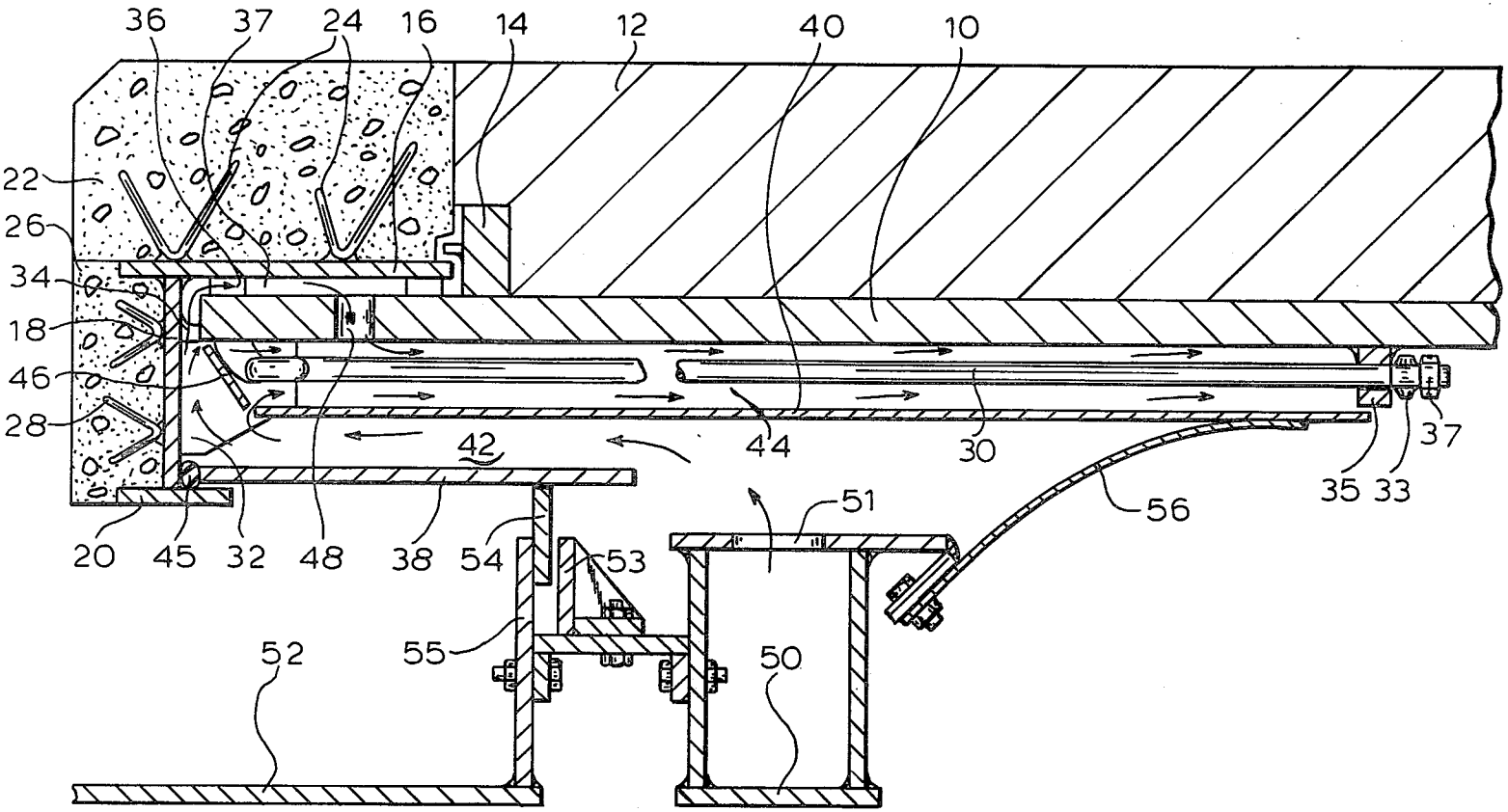
Figure 3:
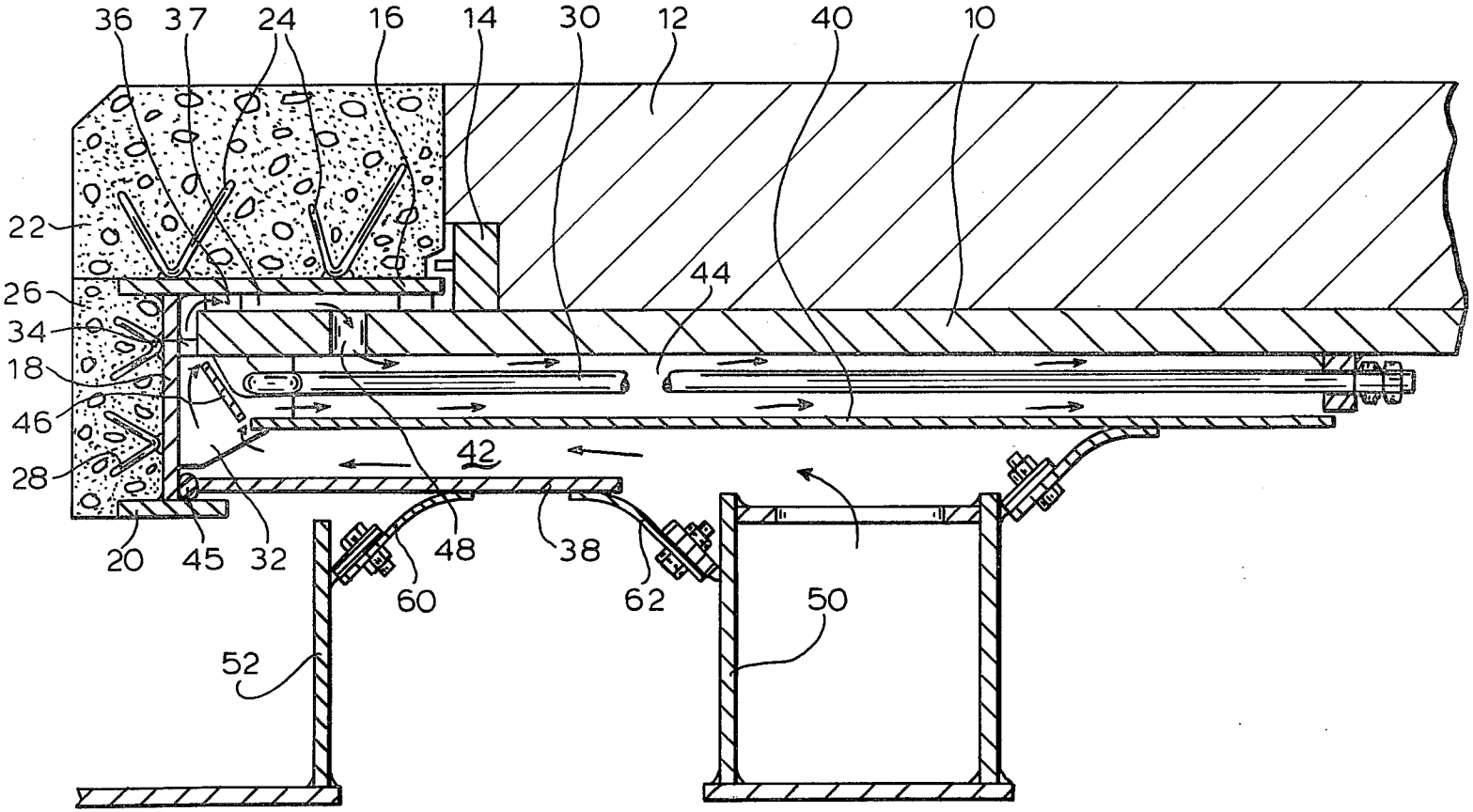
Figure 4:
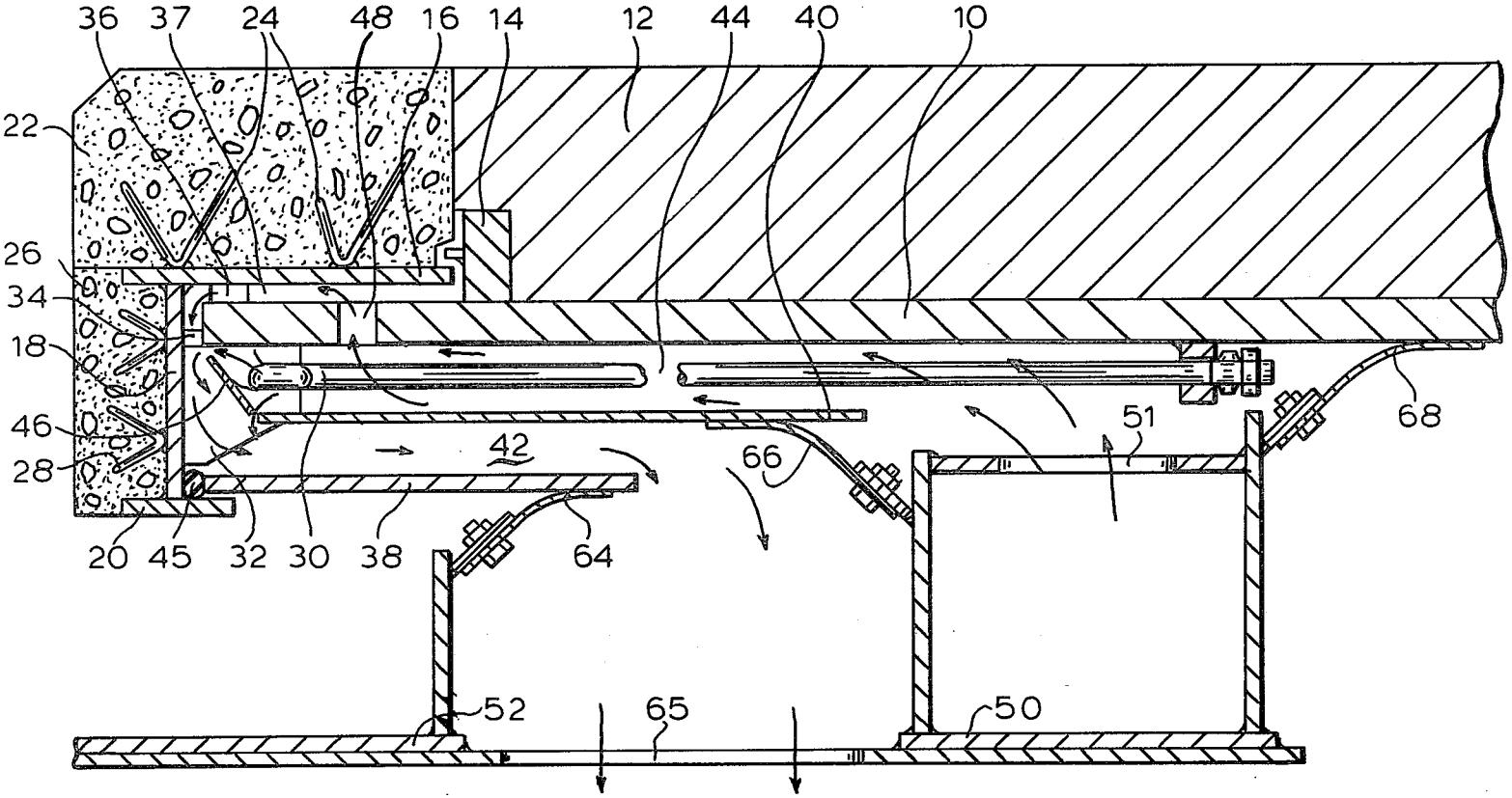

The above and other objects, advantages and features of the present invention will become more apparent from the following detailed description of certain now preferred embodiments thereof, taken in conjunction with the drawing wherein FIG. 1 shows a diagrammatic axial section of the discharge end portion of a tubular rotary kiln incorporating the protective device of this invention;

FIG. 2 is an enlarged partial sectional view illustrating one embodiment of the protective device; and FIGS. 3 and 4 are like view showing two other embodiments.

Referring now to the drawing wherein like reference numerals designate like parts functioning in a like manner in all figures, FIG. 1 shows the discharge end of a tubular rotary kiln mounted in stationary housing 13 for rotation about axis 15 of the kiln. The kiln includes metal shell 10 having an internal and external surface, the metal shell terminating in the discharge end. The internal surface of the metal shell is lined with refractory bricks 12 and this refractory lining terminates at some distance from the end of the metal shell, abutting annular abutment 14 welded to the internal surface of metal shell 10. The discharge end of the kiln is delimited between the end of the metal shell and abutment 14, and the device of the invention is designed to protect this discharge end.

The protective device more fully shown in FIGS. 2 to 4 comprises flange 18 extending radially outwardly of the rotary kiln shell and having a front face and a rear face, a metallic ring 16 affixed to the flange and being arranged concentric with the metal shell at the discharge end, the metallic ring and the internal surface of the metal shell defining space 37 therebetween, and ring 22, 26 of refractory material supported by metallic ring 16 covering the metallic ring and the front face of flange 18 for protecting the internal surface of the shell at the discharge end and the front face of the flange. In the illustrated embodiment, metallic ring 16, flange 18 and outer abutment 20 concentric with the metallic ring constitute a metallic support unit for the refractory ring, ring 16 and abutment 20 extending parallel to axis 15 of the kiln and flange 18 extending perpendicularly thereto and interconnecting the metallic ring and the abutment. This support unit may be an integral annular metal piece cast in one piece or welded together. Alternatively, the support unit may be constituted by segments joined to each other to form the device. The ring of refractory material may be constituted by concrete blocks 22 supported on the metallic ring and concrete blocks 26 supported on the flange and abutment. In the illustrated embodiment, interior concrete block 22 is anchored to metallic ring 16 by anchoring elements 24 and the exterior concrete block 26 is anchored to flange 18 by anchoring elements 28. The joint between the two concrete blocks extends in the annular plane of the internal surface of metallic ring 16 of the support unit. If desired, the refractory material may consist of refractory bricks instead of concrete blocks.

In the preferred embodiments illustrated in the drawing, spacing lugs 34, 36 are disposed between kiln shell 10 and metallic ring 16 and flange 18, spacing lugs 36 being disposed between the internal surface of the metal shell and the metallic ring to position the segments of the support unit radially in relation to the metal shell, and lugs 34 being disposed between the rear face of the flange and the end of the metal shell. In these preferred embodiments, straps 32 are fixed to flange 18 and are in contact with the external surface of kiln shell 10. The support unit segments are fixed to the kiln shell by rods 30 disposed parallel to axis 15 of the shell and extending exteriorly thereof, the rods having one end anchored to straps 32. Mounting lugs 35 are affixed to the external surface of the metal shell, the other ends of rods 30 being attached to the mounting lugs and springs 33 being interposed between the mounting lugs and the other rod ends. As shown, the one rod end is bent over to form a hook engaged in a hole in strap 32 which is welded to flange 18. The other rod end passes through a bore in mounting lug 35 which is welded to metal shell 10. This other rod end is threaded and nut 37 engages the threaded rod end, spring 33 being disposed between the mounting lug and the nut. In this manner, a yielding tension is applied to the support unit segments in the axial direction. Springs 33 may be compressible washers.

The protective device of the present invention further comprises means for cooling the rear face of flange 18 as well as the internal surface of metal shell 10 at the discharge end. This cooling means includes sleeves 38 and 40 concentrically surrounding the external surface of the metal shell, inner sleeve 40 defining annular chamber 44 with the external shell surface and outer sleeve 38 defining another annular chamber 42 with inner sleeve 40, and means 50 for circulating cooling air through annular chambers 42 and 44 past the rear face of flange 18. Space 37 between metallic ring 16 and the internal surface of metal shell 10 communicates with outer annular chamber 42 through a passage defined between the rear face of flange 18 and the discharge end of metal shell 10, and with inner annular chamber 44 through port 48 in the metal shell spaced inwardly of the discharge end. The air circulates in the direction indicated by the arrows.

Sleeves 38 and 40 are affixed to metal shell 10 by conventional means (not shown). Support unit abutment 20 defines, as shown, a small space with the adjacent end of outer sleeve 38 and asbestos gasket 45 constituting a fluid-tight joint is compressed between the end of sleeve 38 and flange 18 of the support unit. In the preferred embodiments, the end of sleeve 40 is spaced from the flange and sheet metal deflectors 46 partially obstruct an end of inner annular chamber 44 adjacent the flange and are arranged to cause a portion of the circulating air to be deflected towards space 37. Deflectors 46 are affixed to straps 32 in the illustrated embodiments and serve to assure simultaneous cooling of the internal and external surfaces of metal shell 10 at the discharge end, the circulating air passing through ports 48 into inner annular cooling chamber 44.

In the preferred embodiments, the cooling air circulating means commprises annular cooling air distributor 50 surrounding metal kiln shell 10 and having an air outlet 51. In the embodiments of FIGS. 2 and 3, air outlet 51 communicates with an end of outer annular cooling chamber 42 remote from flange 18 for delivering the cooling air to the remote end of the outer annular chamber under pressure. A portion of the circulating air is deflected by deflectors 46 into the passage between the end of sleeve 40 and flange 18 to enter space 37 before it passes through ports 48 into annular cooling chamber 44, thus assuring the cooling of the internal surface of metal shell 10 at the discharge end. Spacing lugs 34 and 36 are circumferentially spaced around the metal shell so as not to interfere with the flow of the circulating air. The other portion of the circulating air passes from the outer into the inner annular cooling chamber through slots between deflectors 46, metal shell 10 and sleeve 40, the circulating air in inner chamber 44 assuring the cooling of the external surface of metal shell 10. The air is then vented from the inner cooling chamber.

Annular air distributor 50 is mounted on hood 52 of the kiln and a fluid-tight joint is arranged between the hood and outer sleeve 38. In the embodiment of FIG. 2, this joint is constituted by segments 54 hinged together to form a ring carried by sleeve 38 and extending freely into a space defined between flanges 53 and 55 affixed to hood 52. Another fluid-tight joint 56 is arranged between air distributor 50 and inner sleeve 40, joints 54 and 56 delimiting annular chambers 42 and 44. Joint 56 is constituted by a series of partially flexed resilient sheet metal elements affixed to distributor 50 and frictionally engaging sleeve 40. The sheet metal elements overlap like scales to form the fluid-tight joint.

The embodiment of FIG. 3 differs from that of FIG. 2 by substituting two scale-like joints 60 and 62 for joint 53, 54, 55 between the air distributor and the hood, one of the joints 60 being arranged between the hood and sleeve 38 while the other joint 62 is disposed between distributor 50 and sleeve 40.

In the embodiment of FIG. 4, the direction of air circulation is reversed. Air outlet 51 communicates with an end of inner annular cooling chamber 44 remote from flange 18 for delivering the cooling air to the remote end of the inner annular chamber. Fluid-tight joint 68 is arranged between cooling air distributor 50 and metal kiln shell 10, on the one hand, and fluid-tight joint 66 is arranged between the air distributor and inner sleeve 40, on the other hand, for forming inner annular cooling chamber 44. Fluid-tight joint 64 is disposed between hood 52 and outer sleeve 38, joints 64 and 66 delimiting outer annular cooling chamber 42, and the air being removed through outlet 65. Joints 64, 66 and 68 are formed by scale-like, interleaves flexed resilient sheet metal elements.

While the invention has been described in connection with certain now preferred structural embodiments, it will be obvious to those skilled in the art that this invention is not limited to such embodiments but may be embodied in equivalent structures.

What is claimed is:

1. A protective device for a discharge end of a tubular rotary kiln including a metal shell having an internal and external surface, the metal shell terminating in the discharge end, and the protective device comprising (a) a flange extending radially outwardly of the rotary kiln shell and having a front face and a rear face, (b) a metallic ring affixed to the flange and being arranged concentric with the metal shell at the discharge end, the metallic ring and the internal surface of the metal shell defining a space therebetween, (c) a ring of refractory material supported by the metallic ring covering the metallic ring and the front face of the flange for protecting the internal surface of the shell at the discharge end and the front face of the flange, and (d) means for cooling the rear face of the flange, the cooling means including (1) two sleeves concentrically surrounding the external surface of the metal shell, an inner one of the sleeves defining an annular chamber with the external shell surface and an outer one of the sleeves defining another annular chamber with the inner sleeve, (2) means for circulating cooling air through the annular chambers past the rear face of the flange, and (3) the space between the metallic ring and the internal surface of the metal shell communicating with the outer annular chamber through a passage defined between the rear face of the flange and the discharge end of the metal shell, and with the inner annular chamber through a port in the metal shell spaced inwardly of the discharge end.

2. The protective device of claim 1, further comprising sheet metal deflectors partially obstructing an end of the inner annular chamber adjacent the flange and arranged to cause a portion of the circulating air to be deflected towards the space.

3. The protective device of claim 1 or 2, further comprising means for anchoring the ring of refractory material to the metallic ring and flange.

4. The protective device of claim 3, wherein the metallic ring, the flange affixed thereto and the ring of refractory material supported thereby are constituted by segments joined to each other to form the device.

5. The protective device of claim 4, further comprising spacing lugs between the kiln shell and the metallic ring and flange.

6. The protective device of claim 5, wherein the spacing lugs are disposed between the internal surface of the metal shell and the metallic ring to position the segments radially in relation to the metal shell, and further comprising straps fixed to the flange and in contact with the external surface of the kiln shell.

7. The protective device of claim 6, further comprising means for fixing the segments of the kiln shell, the fixing means comprising rods disposed parallel to the axis of the shell and extending exteriorly thereof, the rods having one end anchored to the straps, and mounting lugs affixed to the external surface of the metal shell, the other ends of the rods being attached to the mounting lugs, springs being interposed between the mounting lugs and the other rod ends.

8. The protective device of claim 6 or 7, further comprising sheet metal deflectors partially obstructing an end of the inner annular chamber adjacent the flange and arranged to cause a portion of the circulating air to be deflected towards the space, the sheet metal deflectors being affixed to the straps.

9. The protective device of claim 1, wherein the cooling air circulating means comprises an annular cooling air distributor surrounding the metal kiln shell, the cooling air distributor having an air outlet communicating with an end of the outer annular chamber remote from the flange for delivering the cooling air to the remote end of the outer annular chamber, and further comprising fluid-tight joints arranged between the cooling air distributor and the sleeves for delimiting the annular chambers.

10. The protective device of claim 1, further comprising an annular cooling air distributor surrounding the metal kiln shell, the cooling air distributor having an air outlet communicating with an end of the inner annular chamber remote from the flange for delivering the cooling air to the remote end of the inner annular chamber, and fluid-tight joints arranged between the cooling air distributor and the metal kiln shell, on the one hand, and the inner sleeve, on the other hand, for forming the inner annular chamber.

11. The protective device of claim 9 or 10, wherein the fluid-tight joints are constituted by partially flexed resilient sheet metal elements affixed to the distributor and frictionally engaging the shell or sleeve.

* * * * *